US007228640B2

(12) United States Patent
Trionfetti

(10) Patent No.: US 7,228,640 B2
(45) Date of Patent: Jun. 12, 2007

(54) FEELER DEVICE FOR WORKPIECES BEING MACHINED

(75) Inventor: Gianni Trionfetti, Agrate Brianza (IT)

(73) Assignee: Balance Systems S.R.L., Milan (IT)

( * ) Notice: Subject to any disclaimer, the term of this patent is extended or adjusted under 35 U.S.C. 154(b) by 0 days.

(21) Appl. No.: 11/198,295

(22) Filed: Aug. 8, 2005

(65) Prior Publication Data

US 2006/0026853 A1 Feb. 9, 2006

(30) Foreign Application Priority Data

Aug. 6, 2004 (IT) ..... MI2004A1623

(51) Int. Cl.
*G01B 5/20* (2006.01)

(52) U.S. Cl. ..... 33/552; 33/555.1

(58) Field of Classification Search ..... 33/501.02, 33/501.04, 551, 552, 553, 554, 555.1, 555.3
See application file for complete search history.

(56) References Cited

U.S. PATENT DOCUMENTS 3,122,838 A 3/1964 Uhlig
3,357,241 A * 12/1967 King, III ..... 33/501.02
3,962,792 A * 6/1976 Stepanek et al. ..... 33/501.04
4,238,886 A 12/1980 Brown
5,099,585 A * 3/1992 Liskow ..... 33/555.1
2006/0042109 A1* 3/2006 Kanai et al. ..... 33/555.1

FOREIGN PATENT DOCUMENTS

EP 0 126 207 A2 11/1984
GB 1 271 841 A 4/1972

* cited by examiner

*Primary Examiner*—G. Bradley Bennett
(74) *Attorney, Agent, or Firm*—Browdy and Neimark, PLLC

(57) ABSTRACT

A feeler device (1) of workpieces being machined, in particular for measurement instruments (2) of workpieces being machined on machine tools, of the type comprising a head (7) including control and measurement members, and a pivoting arm (6) extending in an operating position between the head (7) and a workpiece (3) being machined, the pivoting arm (6) comprising a pivot (10), a base portion (11) extending between the head (7) and the pivot (10), and an end portion (12) extending between the pivot (10) and the workpiece (3) being machined, control means (13) of the pivot (10) being provided, to allow movements between the base portion (11) and the end portion (12) in the event of forcing on the end portion (12).

14 Claims, 2 Drawing Sheets

1
2
3
4
5
6
7
8
9
10
10a
10b
11
11a
12
13
13a
14
14a
15

11
16
14b
13b
17
10
12
7
11a
2
11
10
12
6

7
11
11a
10b
13
10
12

FEELER DEVICE FOR WORKPIECES BEING MACHINED

FIELD OF THE INVENTION

The present invention relates to a feeler device for workpieces being machined, in particular for measurement instruments of workpieces being machined on machine tools, of the type comprising a head including control and measurement members, and at least one pivoting arm extending in an operating position between said head and a workpiece being machined.

DESCRIPTION OF THE PRIOR ART

As it is known, workpieces being machined on machine tools, in particular on grinding machines, can be measured during machining.

The purpose of this is to obtain workpieces which do not require further dimensional checks and which are machined until they reach the proposed optimal conditions.

In this way, a great number of rejects are avoided, and the additional machining operations in some cases required to give the correct measurements to the workpieces machined with insufficient precision.

To measure workpieces during machining—typically workpieces with circular sections ground by abrasive grinding wheels—measurement instruments with at least one feeler device extending in the direction of the workpieces being machined are utilized.

In fact, each feeler device includes, for example, at least one arm having at a first end a pin element terminating with a ball of hard metal or a diamond.

The feeler devices remain in contact with the workpieces being machined and follow the gradual reduction in the diameter thereof thanks to control members inserted in casings or heads, in which the second ends of the arms opposite the first, provided with said pin element, are embedded.

The casings or heads which hold the arms also house measurement members which detect movements of the arms with extreme precision.

Besides having numerous advantages, the aforesaid prior art also has some drawbacks.

A critical point of said measurement instruments can be identified in said feeler devices and in particular in the arms extending between the workpieces being machined and the members for support, control and measurement.

In fact, said arms are easily subject to knocks and forcing, for example during loading and unloading of the workpiece being machined, if the measurement instrument is not first opened, removed or moved away from the machining area, or when it is positioned on the workpiece, if the arms have not first been opened or regulated.

In fact, the feeler device has both an operating position, in which a calibrated and substantially constant contact force is applied to the arms, which tends to move the first ends thereof towards each other, and an open or reloading position, when the arms are moved away from each other in an angular direction to facilitate loading and unloading of the workpiece and positioning of the measurement instrument close to or moved away from said workpiece. Moreover, the type of workpiece being machined may also be varied, and therefore the operating position of the arms must first be re-adjusted. Each time said arms are subjected to knocks or forcing the delicate and expensive control and measurement members connected to the second ends of the arms can be damaged. In this case, costly repairs and noteworthy machine downtimes are necessary.

In practice, it has been found that the knocks and forcing to which the arms are subjected are the most frequent cause of breakages in measurement instruments.

An attempt has already been made to solve this important drawback by providing rupture points at the level of the arms, calculated so that—in the case of knocks or forcing of a certain degree—the arms will break, thereby preventing breakage of the control and measurement members.

In this way major damages are avoided, although the cost and loss of time for replacement of the arms remain.

Moreover, the arms become delicate elements, which must be handled and fitted with the utmost care.

SUMMARY OF THE INVENTION

In this situation, the technical task underlying the present invention is to produce a feeler device for workpieces being machined, in particular for measurement instruments of workpieces being machined on machine tools, capable of substantially overcoming the aforesaid drawbacks.

The technical aim is attained by a feeler device for workpieces being machined, in particular for measurement instruments of workpieces being machined on machine tools of the type comprising a head including control and measurement members, and at least one pivoting arm extending in the operating position between said head and a workpiece being machined, said pivoting arm comprising a pivot, a base portion extending between said head and said pivot, and an end portion extending between said pivot and said workpiece being machined, control means of said pivot being provided suitable to allow movements between said base portion and said end portion in the event of forcing on said end portion.

BRIEF DESCRIPTION OF THE DRAWINGS

The accompanying drawings show preferred embodiments of a device according to the invention. In particular.

DESCRIPTION OF THE PREFERRED EMBODIMENTS

Figures 1, 2:
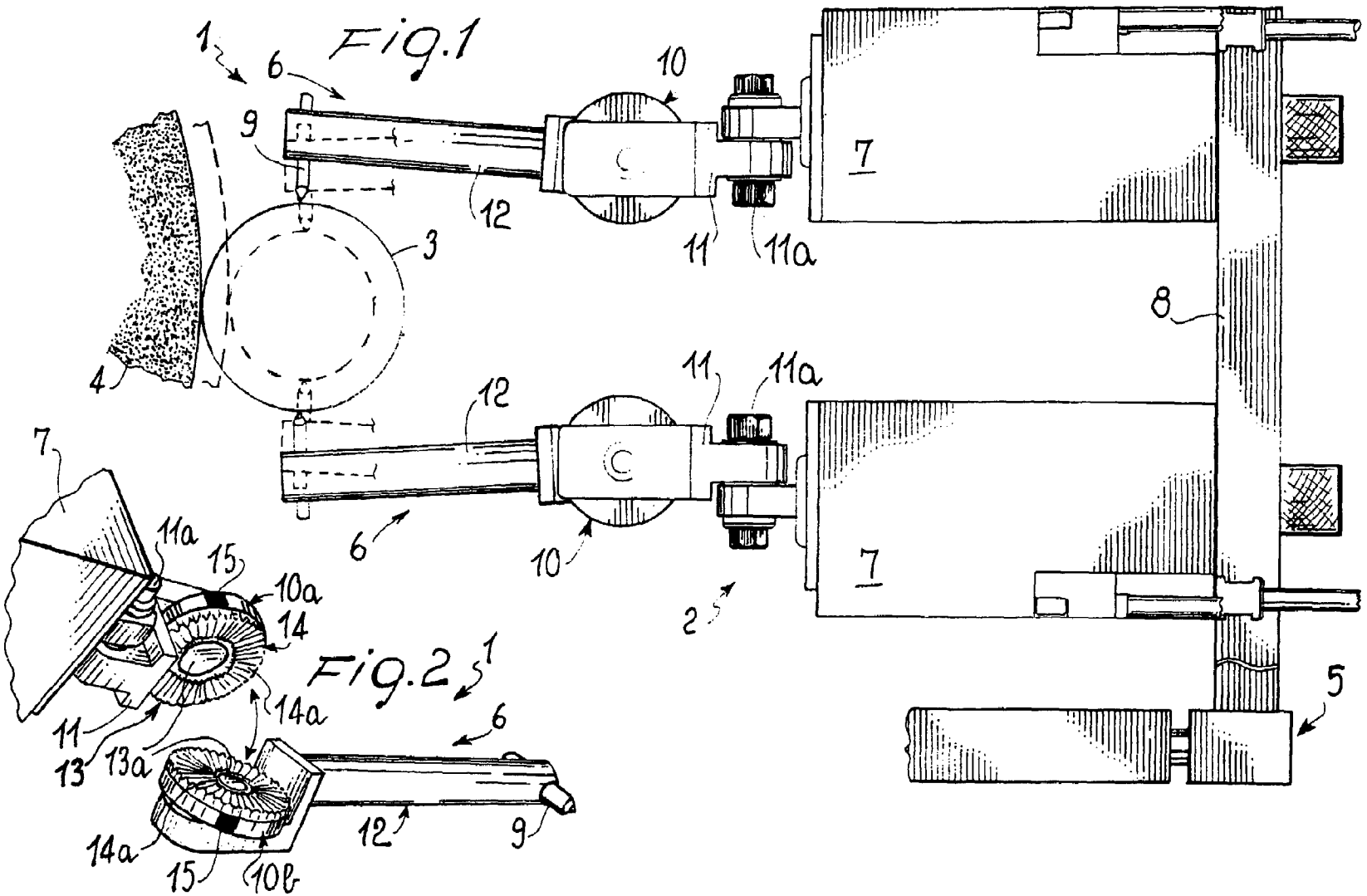
FIG. 1 shows as a whole and in a side elevation a measurement instrument of a grinding machine incorporating the feeler device according to the invention, in two operating positions, one of which shown with a broken line.
FIG. 2 shows the device in a perspective view, in an isolated position and with two of its parts decoupled.

With reference to the Figures, the feeler device according to the invention is indicated as a whole with the number 1. As shown in FIG. 1, the feeler device 1 is part of a measurement instrument 2 of a workpiece 3 being machined.

The feeler device 1 and the measurement instrument 2 are fitted to a grinding machine, of which a grinding wheel 4 and a moving support 5 of the measurement instrument 2 as a whole are shown schematically in FIG. 1.

Summarily, the feeler device 1 comprises at least one pivoting arm 6 extending in the operating position between the workpiece 3 being machined and a head 7 including control and measurement members, per se known.

These members are, for example, explained in the patents U.S. Pat. No. 6,256,898 and EP 0947290 by the same applicant.

A twin arm is normally positioned adjacent to the pivoting arm 6 and each of said arms can be inserted in its own head 7, as shown in FIG. 1, or both can be inserted spaced apart in a single wide head 7, as indicated in said patents by the same applicant.

Each head 7 is then fixed to an upright 8 in turn engaged with said moving support 5, defined for example by a fluid dynamic cylinder in turn mounted on one or more slides, to allow the upright 8 to move in all directions.

On the opposite side of the respective head 7, each pivoting arm 6 is provided, again in a known way, with a pin element 9 terminating with a hard metal ball or a diamond in a position of direct contact with the workpiece 3.

Each pivoting arm 6 has a pivot 10 suitable to divide said arm into a base portion 11 engaged with the head 7 and into an end portion 12 extending in an operating position between the pivot 10 and the workpiece 3 being machined. In the figures the base portion 11 has a joint 11*a* which can be tightened to clamp it and suitable to allow easy replacement without interfering with the head 7.

Moreover, control means 13 of the pivot 10 are provided, suitable to allow movements between the base 11 and end 12 portions at the level of the pivot 13 only in the event of forcing on the end portion 12 in excess of pre-established values.

More specifically, each pivot 10 is preferably defined by at least two component bodies 10*a* and 10*b*, respectively integral with the base portion 11 and with the end portion 12 of the pivoting arm 6, which are substantially separated from each other and which have contact surfaces 14 which can be moved towards each other and reciprocally engaged through the action of the control means 13.

Figures 3, 4, 5:
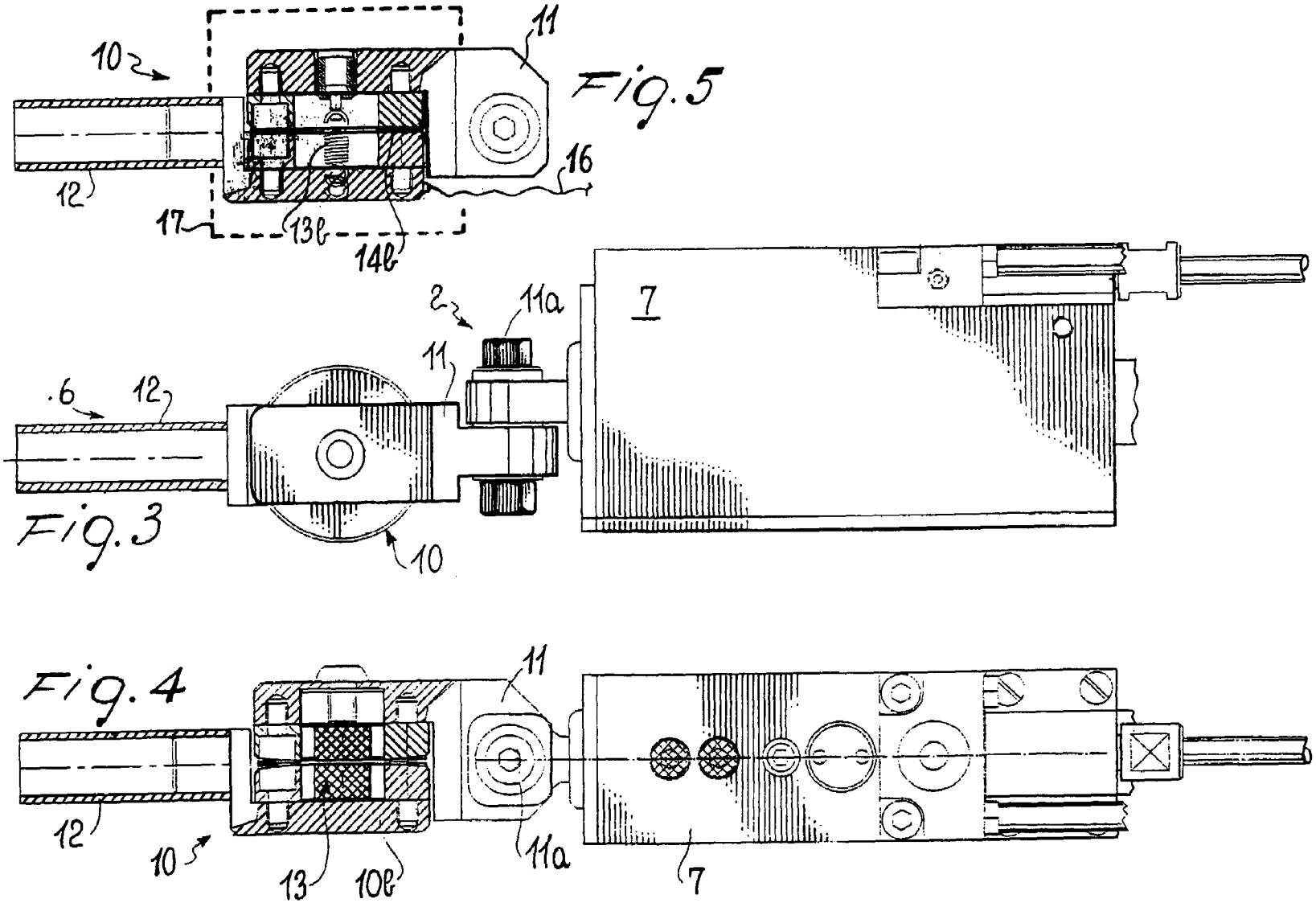
FIG. 3 shows an enlarged side elevation of a portion of FIG. 1.
FIG. 4 shows a plan and partially sectional view of the portion of the device highlighted in FIG. 3.
FIG. 5 shows a portion of the device sectioned analogous to FIG. 3 and highlighting a variant of embodiment.

Said contact surfaces are preferably defined by teeth 14*a* which mesh with each other, and alternatively by friction areas 14*b* (FIG. 5) with high friction. The control means 13 are defined by magnetic elements 13*a* and alternatively by elastic means 13*b* positioned at the level of the pivot 10.

It would also be possible for the control means 13 to be defined by members to tighten said component bodies suitably calibrated.

In the figures the component bodies 10*a*, 10*b* of the pivot 10 are defined by disks facing each other at the level of the contact surfaces 14.

The latter preferably engage a substantially peripheral annular portion of said disks, and the control means 13—defined by the magnetic elements 13*a* or by the elastic means 13*b*—are arranged coaxial to the disks.

The teeth 14*a* define frontal toothings placed at the level of said contact surfaces 14 and consist of a plurality of small teeth to allow a plurality of angular positions between said base portion and said end portion of said arm. The magnetic elements 13*a* are produced by one or more permanent magnets, while the elastic means 13*b* are produced by a traction spring. Marking elements 15 are provided on the periphery of the pivot 10, suitable to facilitate reciprocal angular positioning of the component bodies 10*a*, 10*b*. Preferably, connection elements 16 are also provided (FIG. 5), suitable to prevent the end portion 12 of the pivoting arm 6 from dropping, defined for example by a rope or the like which connects, with ample slack, the end portion 12 to the upright 8 or to another part of the instrument.

Cover-like enveloping elements 17 may also be provided on the pivot 10, suitable to substantially isolate it from the outside environment, to protect it from dust and oily slime. These enveloping elements can also substantially replace the connection elements 16.

Operation of the feeler device is as follows.

In normal operating conditions, each pivoting arm 6 behaves like a single element and the heads 7 can precisely detect all movements of said arm, which has a pin element 9 in contact with the workpiece 3 being machined. Instead, in the presence of knocks or forcing, the base portion 11 and the end portion 12 are decoupled, to prevent damage to the head 7.

In particular, the base portion 11 remains normally engaged with the relative head 7, while the end portion 12 detaches and/or moves freely with respect to the base portion.

Decoupling takes place at the level of and thanks to the pivot 10, in which the component bodies 10*a* and 10*b* are engaged with each other with a limited force, determined by magnets or elastic means.

Decoupling does not cause any breakage and can be extremely easy to re-establish the coupling, using the marking elements 15 if required.

The arrangement of frontal toothings determines high precision and stability of position.

The frontal toothings also allow the position of the end portions 12 to be set as a function of the diameter of the workpiece to be measured: in other words, the base portion 11 and the end portion 12 of each pivoting arm 6 can also be arranged angled with each other as desired, in order to move the pin elements 9 away from or towards each other.

The invention allows important advantages to be obtained.

In fact, the dangers of damage to the heads are eliminated at the source, without this leading to breakage or replacement of the arms.

Moreover, their versatility is greatly emphasized, as it is possible to position the end portion 12 in the most suitable way with respect to the base portion 11.

By providing one or two permanent magnets with suitable magnetic action, or suitable springs, it is also possible to widely vary, according to needs and to the delicacy of the heads, the cohesion force between the two parts of the arms.

The feeler device can also be easily applied to measurement instruments already on the market.

The invention claimed is:

1. Feeler device of workpieces being machined, in particular for measurement instruments of workpieces being machined on machine tools, of the type comprising a head (7) including control and measurement members, and at least one pivoting arm (6) extending in an operating position between said head (7) and a workpiece (3) being machined, said pivoting arm (6) comprising a pivot (10), a base portion (11) of said arm (6) fixed between and to both said head (7) and said pivot (10), and an end portion (12) of said arm having a first end fixed to said pivot (10) and extending from said pivot (10) to a second free end engageable to said workpiece (3) being machined wherein said pivot (10) has control apparatus which allows said end portion (12) to rotate relative to said base portion (10) in the event of forcing on said end portion (12).

2. Feeler device as claimed in claim 1, wherein said pivot (10) comprises at least two component bodies (10*a*, 10*b*) respectively fixed to said base portion (11) and said end portion (10), having respective contact surfaces (14) which can be moved towards each other, said control apparatus (13) being suitable to removably engage said component bodies (10*a*, 10*b*) with each other at the level of said contact surfaces (14).

3. Feeler device as claimed in claim 2, wherein said contact surfaces (14) comprise teeth (14*a*) which mesh with one another.

4. Feeler device as claimed in claim 3, wherein a plurality of said teeth (14*a*) are provided, suitable to allow a plurality of angular positions between said base portion (11) and said end portion (12) of said pivoting arm (6).

5. Feeler device as claimed in claim 2, wherein said contact surfaces (14) include friction areas (14*b*) with high friction.

6. Feeler device as claimed in claim 2, wherein said control apparatus (13) include magnetic elements (13*a*).

7. Feeler device as claimed in claim 2, wherein said control apparatus (13) include an elastic element (13*b*).

8. Feeler device as claimed in claim 2, wherein said component bodies (10*a*, 10*b*) are substantially defined by disks facing each other at the level of said contact surfaces (14).

9. Feeler device as claimed in claim 8, wherein said contact surfaces (14) engage a substantially peripheral annular portion of said disks (10*a*, 10*b*), and wherein said control apparatus (13) is arranged coaxial to said disks (10*a*, 10*b*).

10. Feeler device as claimed in claim 9, wherein said disks (10*a*, 10*b*) have frontal toothings at the level of said contact surfaces (14) and at least one permanent magnet coaxial to at least one of said disks (10*a*, 10*b*).

11. Feeler device as claimed in claim 9, wherein said disks (10*a*, 10*b*) have frontal toothings at the level of said contact surfaces (14) and at least one traction spring coaxial to said disks (10*a*, 10*b*).

12. Feeler device as claimed in claim 8, wherein marking elements (15) are provided, suitable to facilitate reciprocal positioning of said disks (10*a*, 10*b*).

13. Feeler device as claimed in claim 2, wherein connection elements (16) are provided, suitable to prevent the end portion (12) of the pivoting arm (6) from dropping.

14. Feeler device as claimed in claim 2, wherein enveloping elements (17) are provided on said pivot (10) and suitable to substantially isolate said pivot (10) from the outside environment.

* * * * *